United States Patent [19]

Keane

[11] Patent Number: 4,639,055

[45] Date of Patent: Jan. 27, 1987

[54] HOSE COUPLING FOR VACUUM CLEANER

[75] Inventor: James W. Keane, Ramsey County, Minn.

[73] Assignee: Whirlpool Corporation, Benton Harbor, Mich.

[21] Appl. No.: 740,624

[22] Filed: Jun. 3, 1985

[51] Int. Cl.[4] ..... H01R 3/00

[52] U.S. Cl. ..... 339/16 R; 339/15

[58] Field of Search ..... 339/15, 16 R; 174/47; 285/7, 320

[56] References Cited

U.S. PATENT DOCUMENTS

| | | | |
|---|---|---|---|
| 2,516,907 | 8/1950 | Penfold | 285/7 |
| 3,034,085 | 5/1962 | Pauler et al. | 339/16 |
| 3,127,227 | 3/1964 | Edwards | 339/15 |
| 3,314,039 | 4/1967 | Opper | 339/15 |
| 3,636,285 | 1/1972 | Wickham et al. | 200/51 R |
| 3,860,316 | 1/1975 | Hardesty | 339/91 R |
| 3,928,715 | 12/1975 | Holden | 174/47 |
| 4,012,091 | 3/1977 | Westergren | 339/15 |
| 4,018,493 | 4/1977 | Lyman et al. | 339/15 |
| 4,063,790 | 12/1977 | Kleykamp et al | 339/16 R |
| 4,188,081 | 2/1980 | Holden et al. | 339/15 |
| 4,211,457 | 7/1980 | Meadows | 339/15 |
| 4,283,594 | 8/1981 | Somers | 174/47 |

*Primary Examiner*—John McQuade

*Attorney, Agent, or Firm*—Wood, Dalton, Phillips, Mason & Rowe

[57] ABSTRACT

A current-carrying vacuum cleaner air hose having an electrical conductor extending lengthwise thereof, with a cuff at one end. Male electrical terminals are embedded in the cuff and project outwardly into a tubular adapter enclosure portion. A catch is formed integrally with the adapter for cooperation with a coupling element to releasably secure the hose end in connected association with the coupling element, which illustratively is provided as a portion of a vacuum cleaner canister.

12 Claims, 4 Drawing Figures

HOSE COUPLING FOR VACUUM CLEANER

BACKGROUND OF THE INVENTION

1. Field of the Invention

This invention relates to vacuum cleaner hose constructions and, in particular to vacuum cleaner hose constructions provided with electrical conductors for electrical energization of an element at a distal end of the hose.

2. Description of the Background Art

In U.S. Pat. No. 4,012,091 of George A. Westergren, which patent is owned by the assignee hereof, a current-carrying vacuum cleaner hose is disclosed having replaceable electrical terminals. The terminals are carried on a mounting member defining a terminal adapter engageable with terminals carried by the hose end. The terminal adapter, in turn, is retained in association with the hose end by a snap-in hose end adapter or, alternatively, may be secured to the hose end by securing means associated with the hose end itself.

In U.S. Pat. No. 3,034,085, which patent is owned by the assignee hereof, Charles J. Pauler et al. disclose a combined fluid and electrical connector having a tubular coupler including a first portion fixed to the end of the air hose and a second portion attached to the first portion for removable association with a vacuum cleaner apparatus, such as a canister. The ends of the electrical connector are provided in a plug which is mounted within a portion of the cuff.

A connector structure generally similar to that of the Pauler et al. patent is shown in U.S. Pat. No. 4,018,493 of John B. Lyman et al., which patent is owned by the assignee hereof.

SUMMARY OF THE INVENTION

The present invention comprehends an improved current-carrying vacuum cleaner air hose structure wherein a pair of contact pins are molded integrally in the molded cuff end in electrically conductive association with the electrical conductor extending lengthwise of the hose.

The contact pins extend through a guide means provided on an adapter secured to the cuff.

The pins extend into an enclosure, or housing, portion of the adapter, which serves as a guide in connecting the electrical terminals to complementary electrical terminals provided on a coupling element, such as in the canister of the vacuum cleaner apparatus.

The adapter may be provided with a manipulatable catch for locking the hose end to the coupling element.

In the illustrated embodiment, the catch is located adjacent the enclosure and, thus, the electrical terminals.

More specifically, in the illustrated embodiment, the catch is located about the axis of the tubular adapter approximately 90° from the enclosure and terminals.

The vacuum cleaner hose end terminal structure is extremely simple and economical of construction while yet providing for long, troublefree life in the use of the apparatus.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
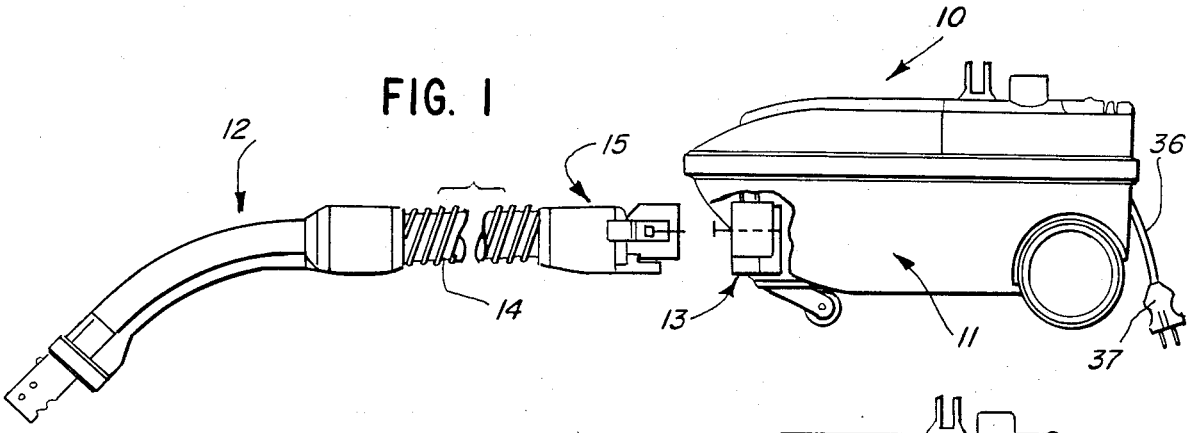
FIG. 1 is a fragmentary side elevation of a vacuum cleaner structure embodying the invention, with the hose end spaced from the coupling element of the canister.
Figure 2:
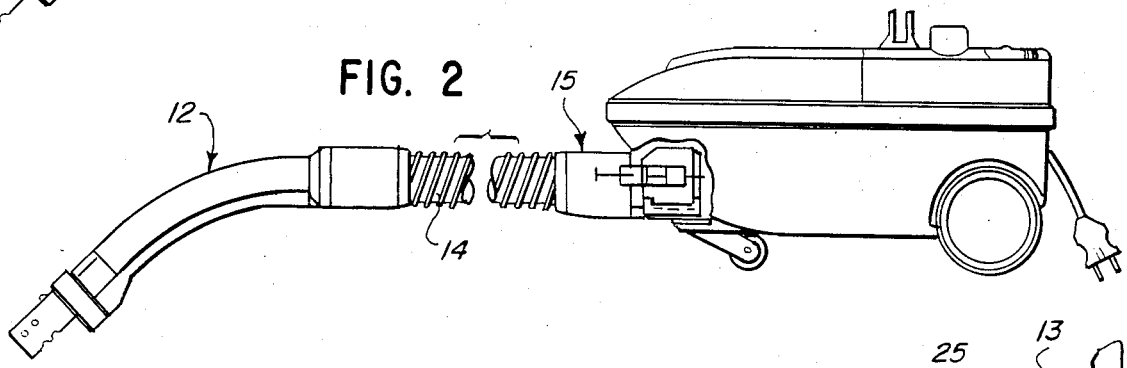
FIG. 2 is a side elevation similar to that of FIG. 2, but with the hose end connected to the coupling element.

In the illustrative embodiment of the invention as disclosed in the drawing, a vacuum cleaner structure generally designated 10 is shown to comprise a canister 11 and a suction hose 12. The suction hose may be connected, at its distal end, to a wand (not shown).

As shown in FIG. 1, the canister includes a coupling element 13. The hose is provided with electrical conductors 14 embedded therein and extending spirally the length of the hose for conducting electrical power from the canister to the wand for energization of an electrical device associated with the wand, such as a brush motor for driving a brush of a nozzle assembly provided at the distal end of the wand (not shown).

Figure 3:
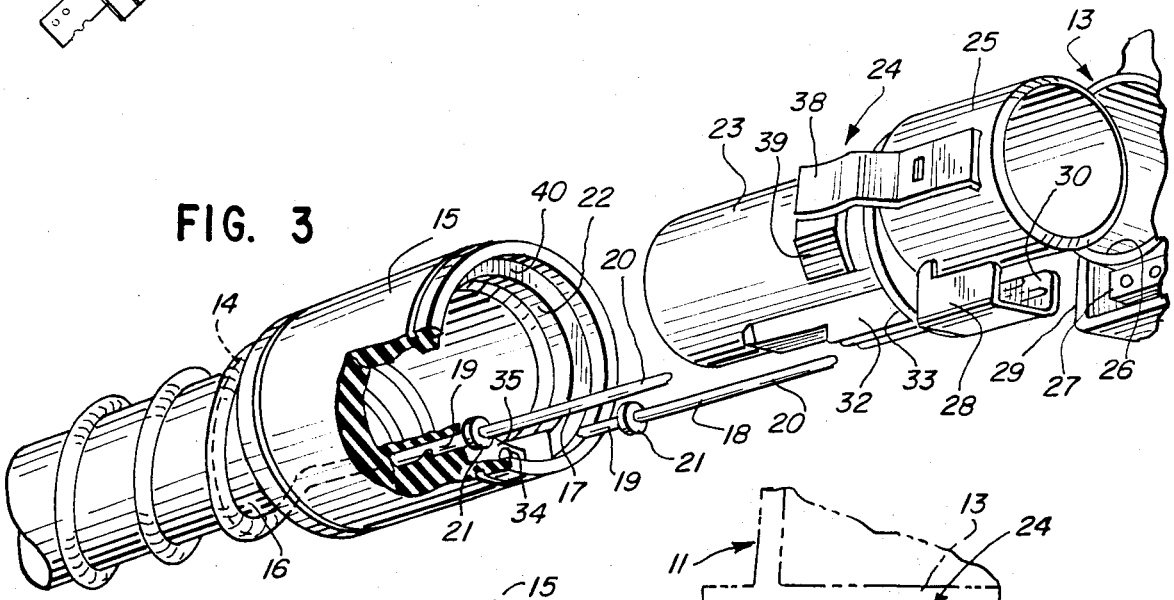
FIG. 3 is a fragmentary exploded view illustrating in greater detail the construction of the hose end and adapter.

As seen in FIG. 3, the electrical conductors, only one of which is shown, terminate in a molded cuff 15 formed on the end 16 of the hose. The cuff is formed of a suitable synthetic resin as by molding. The invention comprehends the provision of a pair of male terminals in the form of contact pins 17 and 18 embedded in the cuff and in electrically connected association with the ends of the conductors 14.

Each of the contact pins is defined by an inner connector portion 19 and an outer male terminal portion 20. Intermediate portions 19 and 20, each pin is provided with an annular collar 21 for locking the contact pin to the cuff when the adapter is installed therein.

The cuff defines a tubular socket 22 receiving one end 23 of a tubular adapter 24. The outer end 25 of the adapter is arranged to be slidably received in an outlet 26 of the coupling element 13. The coupling element further defines a female electrical connector plug portion 27 adjacent the outlet opening 26, as best seen in FIG. 3.

Adapter 24 is provided with an enclosure, or housing, 28 acting as a guide in coaction with a complementary enclosure, or housing, portion 29 on the coupling element 13 surrounding the plug 27.

Figure 4:
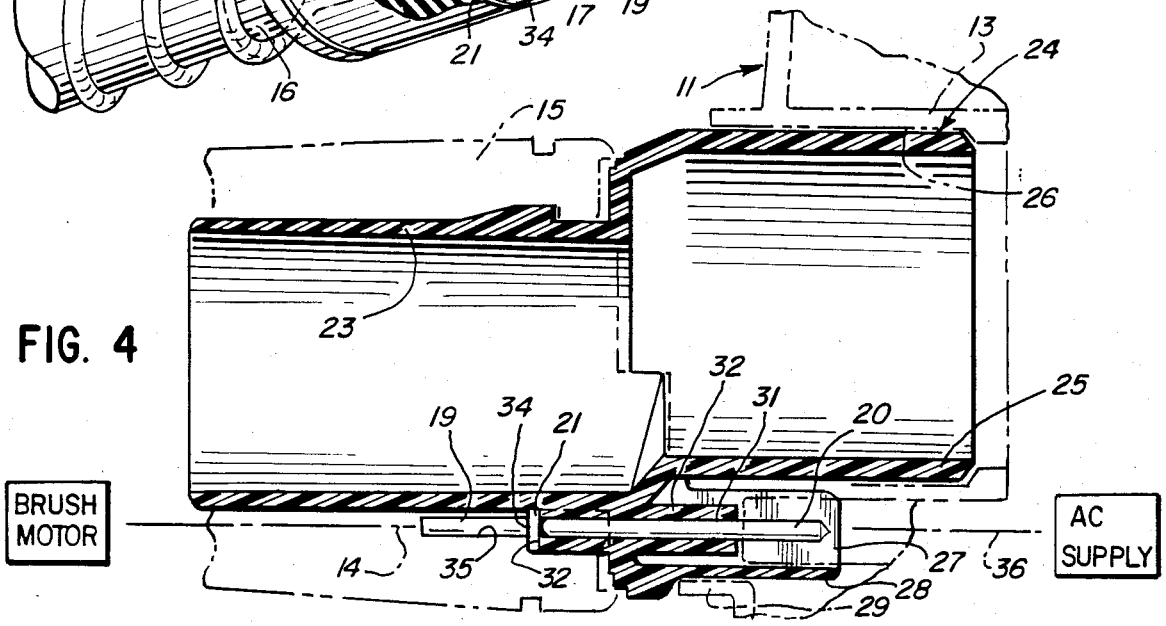
FIG. 4 is a fragmentary diametric section illustrating the arrangement of the apparatus with the hose end connected to the coupling element of the canister.

The adapter housing defines a passage 30 into which the male terminal portions 20 of the contact pins 17 and 18 extend when the adapter is connected to the cuff, with the adapter end 23 received in the socket 22, as shown in FIG. 4.

The terminal portions 20 are slidably received in a through passage 31 provided in a projecting portion 32 of the adapter received in the enclosure 28. When the adapter end 23 is installed in the cuff socket 22, the distal end 33 of the adapter abuts the collar 21. The pin end 19 is received in an opening 34 in a mounting portion 35 of the cuff, and is maintained in electrical connection with the conductor 14 in the opening 34.

Thus, the contact pins 17 and 18 are removably secured to the cuff in electrical association with the conductors 14 as an incident of the adapter 24 being connected to the cuff. The terminals may be readily replaced by removal of the adapter from the cuff. However, normally, the adapter is retained in association with the cuff and, thus, the adapter comprises means for normally retaining the terminals connected to the conductor wires 14.

As illustrated schematically in FIG. 4, the female connector 27 may be connected to a conventional AC power supply through a cord 36 which may include a conventional plug 37, as shown in FIG. 1.

The adapter may be releasably retained in association with the coupling element 13 on canister 11 by means of a catch 38 which is manipulatable so as to release the inserted adapter end 25 from the coupling element 13.

Adapter portion 23 is provided with a lug 39 adapted to be received in a groove 40 in the socket 22 for retaining the adapter in association with the cuff.

The assembly of the hose end structure is extremely simple. Thus, the contact pin ends 19 are inserted in the openings 34 of the plug 35 formed integrally with the cuff 15 so as to provide electrical connection of the contact pin portions 19 with the ends of the electrical conductors 14, as seen in FIG. 3. The insertion of the adapter portion 23 into the socket 22 is then effected, with the terminal portions 20 of the contact pins passing through the opening 31 in the projection 32 of the adapter so as to expose the distal ends of the terminals 20 in the space 27 within enclosure 28, as illustrated in FIG. 4. The engagement of the stop shoulder 33 with the collars 21 of the contact pins locks the collars to the cuff in the openings 34, as illustrated in FIG. 4, as an incident of the insertion of the adapter portion 23 fully into socket 22. Thus, the cuff end structure is automatically arranged to define a male connector adapted to be removably connected to the female connector 27 as an incident of the connection of the adapter portion 25 to the coupling element 13. During such connection, enclosure 28 acts as a guide in aligning the male contact terminal portions 20 with the female plug 27 so as to automatically effect the electrical connection to the conductor 36 and AC power supply as an incident of connection of the adapter to the coupling element 13.

In the illustrated embodiment, the catch 38 is disposed approximately 90° about the axis of the tubular adapter from the location of the enclosure 28 and, thus, the terminal portions 20 of the contact pins in the assembled arrangement of the hose end. Such disposition further facilitates the guiding of the male electrical connection means into connected association with the female electrical connection means.

The invention effectively eliminates the need for providing premounted male terminals, as the adapter itself defines the means for accurately locating the terminals and retaining them in electrically connected association with the hose conductors 14. Thus, the terminal structure is extremely simple and economical, while yet providing facilitated manufacture and long, troublefree life.

The foregoing disclosure of specific embodiments is illustrative of the broad inventive concepts comprehended by the invention.

I claim:

1. In a current-carrying vacuum cleaner air hose having electrical conductors extending lengthwise thereof, an end provided with a cuff, said conductors having ends at said cuff end, and a tubular adapter connected to said cuff and defining means for connecting the hose end and conductor ends to a coupling element to provide an air flow connection and an electrical connection therebetween, the improvement comprising:

a pair of separate contact pins removably mountable on said cuff end respectively in electrically conductive association with said conductor ends and projecting through said adapter to define electrical connection means for electrical connection to said coupling element;

guide means on said adapter for guiding said pins into electrical connection to said coupling element as an incident of the adapter being associated with the coupling element to have air flow connection therebetween; and means on said adapter for retaining said pins separately in said electrically conductive association with said electrical conductors as a result of said adapter being connected to said cuff.

2. The current-carrying vacuum cleaner air hose structure of claim 1 wherein said cuff comprises a molded body of synthetic resin and includes a support integrally molded therein for receiving ends of the contact pins for electrical connection to the electrical conductors therein.

3. The current-carrying vacuum cleaner air hose structure of claim 1 wherein said guide means comprises wall means on the adapter defining a through passage and said contact pins extend into said through passage.

4. The current-carrying vacuum cleaner air hose structure of claim 1 wherein said guide means comprises wall means on the adapter defining a through passage and said contact pins terminate outwardly in said through passage.

5. The current-carrying vacuum cleaner air hose structure of claim 1 wherein said guide means comprises wall means on the adapter defining a through passage and said contact pins extend into said through passage, said guide means defining an elongated projection supporting a portion of the contact pins in said adapter.

6. In a current-carrying vacuum cleaner air hose having electrical conductors extending lengthwise thereof, an end provided with a cuff, each of said conductors having an end at said cuff end, and a tubular adapter connected to said cuff and defining means for connecting the hose end and conductor ends to a coupling element to provide an air flow connection and an electrical connection therebetween, the improvement comprising:

a pair of separate contact pins removably mounted on said cuff end respectively in electrically conductive association with said conductor end and projecting through said adapter to define electrical connection means for electrical connection to said coupling element;

guide means on said adapter for guiding said pins into electrical connection to said coupling element as an incident of the adapter being associated with the coupling element to have air flow connection therebetween;

manipulatable catch means formed integrally with said adapter for cooperation with the coupling element to releasably secure the hose end in connected association with said coupling element; and means on said adapter for retaining said pins separately in said electrically conductive association with said electrical conductors as a result of said adapter being connected to said cuff.

7. The current-carrying vacuum cleaner air hose structure of claim 6 wherein said cuff comprises a molded body of synthetic resin and includes a support and means integrally molded therein for receiving an end of the contact pins for electrical connection to the electrical conductor therein.

8. The current-carrying vacuum cleaner air hose structure of claim 6 wherein said adapter defines a longitudinal axis and said guide means and catch means are spaced apart approximately 90° about said axis.

9. In a vacuum cleaner hose having electrical conductors extending lengthwise thereof and terminating in a cuff at one end of the hose, the improvement comprising:

male electrical terminals comprising separate pins individually removably mounted in said cuff and having ends projecting therefrom; and hose connection means having means for releasably locking the terminals to said cuff in electrically connected association with said electrical conductors.

10. The vacuum cleaner hose structure of claim 9 further including enclosure means integral with the hose connection means and enclosing the male terminal ends.

11. The vacuum cleaner hose structure of claim 9 further including manipulatable catch means integral with the hose connection means adjacent said male terminals.

12. The vacuum cleaner hose structure of claim 9 further including enclosure means integral with the hose connection means and enclosing the male terminal ends, and manipulatable catch means integral with the hose connection means adjacent said enclosure means.

* * * * *